US008158029B2

(12) United States Patent
Ernst

(10) Patent No.: US 8,158,029 B2
(45) Date of Patent: Apr. 17, 2012

(54) METHOD FOR THE PRODUCTION OF SYNTHESIS GAS AND OF OPERATING A FIXED BED DRY BOTTOM GASIFIER

(75) Inventor: Werner Siegfried Ernst, Secunda (ZA)

(73) Assignee: Sasol Technology (Proprietary) Limited, Johannesburg (ZA)

( * ) Notice: Subject to any disclaimer, the term of this patent is extended or adjusted under 35 U.S.C. 154(b) by 642 days.

(21) Appl. No.: 12/375,633

(22) PCT Filed: Jul. 30, 2007

(86) PCT No.: PCT/IB2007/053002

§ 371 (c)(1),
(2), (4) Date: Jan. 29, 2009

(87) PCT Pub. No.: WO2008/015630

PCT Pub. Date: Feb. 7, 2008

(65) Prior Publication Data

US 2009/0261296 A1 Oct. 22, 2009

(30) Foreign Application Priority Data

Aug. 1, 2006 (ZA) ..... 2006/06359

(51) Int. Cl.
*C01B 3/02* (2006.01)
*C07C 27/06* (2006.01)

(52) U.S. Cl. ..... 252/373; 518/703

(58) Field of Classification Search ..... 252/373; 518/703

See application file for complete search history.

(56) References Cited

U.S. PATENT DOCUMENTS

| | | | | |
|---|---|---|---|---|
| 4,150,953 | A | 4/1979 | Woodmansee | |
| 6,225,358 | B1 | 5/2001 | Kennedy | |
| 6,648,931 | B1 | 11/2003 | Rao | |
| 6,664,302 | B2 * | 12/2003 | French et al. | 518/700 |
| 2001/0045397 | A1 * | 11/2001 | Shah | 210/758 |

OTHER PUBLICATIONS

International Search Report mailed Feb. 29, 2008.

* cited by examiner

*Primary Examiner* — Wayne Langel
(74) *Attorney, Agent, or Firm* — Wood, Herron & Evans, LLP

(57) ABSTRACT

A method (10) for the production of synthesis gas includes humidifying an oxygen-containing stream (40) by contacting the oxygen-containing stream (40) with a hot aqueous liquid (58) to produce a humidified oxygen-containing stream (42), and feeding the humidified oxygen-containing stream (42) into a gasifier (20) in which a carbonaceous material (44) is being gasified, thereby to produce synthesis gas.

15 Claims, 3 Drawing Sheets

Figure 1:
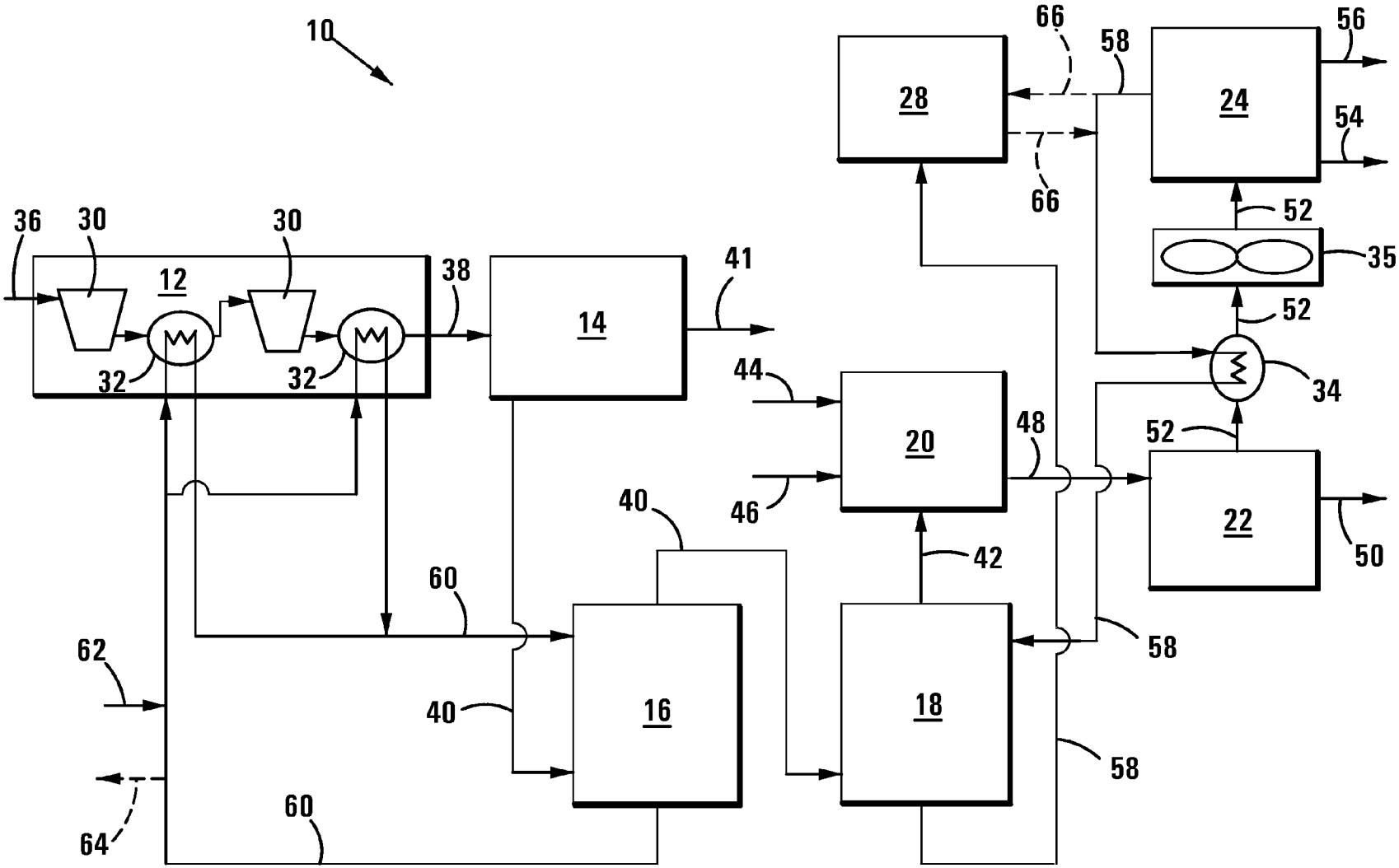

METHOD FOR THE PRODUCTION OF SYNTHESIS GAS AND OF OPERATING A FIXED BED DRY BOTTOM GASIFIER

CROSS-REFERENCE TO RELATED APPLICATIONS

The present application is a U.S. National Stage under 35 U.S.C. §371 of International Patent Application No. PCT/IB2007/053002, filed Jul. 30, 2007, which claims priority to South African Patent Application No. 2006/06359, filed Aug. 1, 2006, the disclosures of which are incorporated by reference herein in their entireties.

THIS INVENTION relates to a method for the production of synthesis gas, and to a method of operating a fixed bed dry bottom gasifier.

There are various gasification technologies available to gasify a carbonaceous material, such as coal, to produce synthesis gas. With suitable coal used for fixed bed dry bottom gasification technology, less oxygen and coal are required for the production of a particular effective amount of synthesis gas than with high temperature gasification technologies, especially for coal containing a lot of inorganic matter and inherent moisture. (Effective synthesis gas is defined as that part of a synthesis gas that can potentially be converted into hydrocarbon product given the chosen product slate and conversion technology). However, the use of steam as gasification or moderating agent is higher when fixed bed dry bottom gasification technology is employed compared to other gasification technologies. If the coal required for steam production is included, the benefit provided by fixed bed dry bottom gasification technology of using less coal, compared to alternative high temperature gasification technologies, to produce an effective amount of syngas, is reduced or nullified.

According to one aspect of the invention, there is provided a method for the production of synthesis gas, the method including humidifying an oxygen-containing stream by contacting the oxygen-containing stream with a hot aqueous liquid to produce a humidified oxygen-containing stream; and feeding the humidified oxygen-containing stream into a gasifier in which a carbonaceous material is being gasified, thereby to produce synthesis gas.

The term "gasifier" in this specification is used in the conventional sense, i.e. an apparatus for converting a hydrocarbonaceous feedstock that is predominantly solid (e.g. coal) or liquid into synthesis gas, as opposed to "reformer" which is an apparatus for the conversion of a predominantly gaseous hydrocarbonaceous feedstock to synthesis gas.

In a preferred embodiment of the invention, the gasifier is a low temperature non-slagging gasifier, such as a low temperature fixed bed dry bottom gasifier (also known as a dry ash moving bed gasifier), e.g. a low temperature Sasol-Lurgi (trade name) fixed bed gasifier.

In addition, certain types and/or applications of entrained flow gasifiers (i.e. high temperature slagging gasifiers), fixed bed slagging gasifiers, transported bed gasifiers, or fluidised bed gasifiers employ steam as a feedstock, albeit in lower amounts than what is used in low temperature non-slagging gasifiers. Such steam may for example be used as a moderator to protect burners of the gasifiers having burners, or to adjust the $H_2/CO$ ratio of synthesis gas produced by a gasifier. Thus, in different embodiments of the invention, the gasifier may be an entrained flow gasifier, or a fixed bed slagging gasifier, or a transported bed gasifier, or a fluidised bed gasifier.

According to another aspect of the invention, there is provided a method of operating a fixed bed dry bottom gasifier, the method including humidifying an oxygen-containing stream by contacting the oxygen-containing stream with a hot aqueous liquid to produce a humidified oxygen-containing stream;

feeding the humidified oxygen-containing stream, steam and solid carbonaceous material into said fixed bed dry bottom gasifier;

in the gasifier, gasifying the solid carbonaceous material in the presence of oxygen and steam to produce synthesis gas and ash; and removing the synthesis gas and ash from the gasifier.

The method may include producing the oxygen-containing stream in an air separation unit (ASU), preferably a cryogenic ASU.

Humidifying the oxygen-containing stream typically includes heating the oxygen-containing stream, by directly contacting the oxygen-containing stream with the hot aqueous liquid. The theoretical maximum temperature to which the oxygen-containing stream may be preheated by such direct contact is set by the saturation temperature of water at the oxygen system pressure. At an oxygen system pressure of 3 000 kPa (absolute), the theoretical maximum preheat temperature is below 234° C., and it is below 257° C. at a system pressure of 4 500 kPa (absolute). In particular, at typical gasifier operating conditions, the humidified oxygen-containing stream being fed into the gasifier may be at a temperature of at least 160° C., preferably at least about 200° C., more preferably at least about 220° C.

At conditions typically encountered, the humidified oxygen-containing stream being fed into the gasifier may have a water concentration of at least about 3% by volume, preferably at least about 20% by volume, more preferably at least about 40% by volume, typically between about 40% and about 90% by volume, more typically between about 40% and about 70% by volume, e.g. about 65% by volume, as a result of being humidified by the hot aqueous liquid.

Typically, the humidified oxygen-containing stream is at a pressure of between about 2 000 kPa (absolute) and about 6 000 kPa (absolute).

The oxygen-containing stream may be humidified in one or more humidification stages. In one or in a first humidification stage, the oxygen-containing stream may be contacted with water used as cooling water. The cooling water may be of boiler feed quality and may then be used in a substantially closed circuit. By water of boiler feed quality is meant water suitable for steam generation in typical coal fired boilers (e.g. at 40 bar (gauge)) having a conductivity less than 120 micro-Siemens. The cooling water is thus typically used in indirect heat exchange with one or more hot process streams produced in a complex using or producing the synthesis gas. In one embodiment of the invention, the cooling water is used to cool a compressed gaseous stream in said ASU. Advantageously, this reduces the need for normal cooling water from a plant cooling water circuit and, for a plant cooling water circuit making use of an evaporative cooling tower, thus also reduces the loss of water to atmosphere.

When the cooling water is used to cool a compressed gaseous stream in said ASU, the cooling water being used to humidify the oxygen-containing stream may have a feed temperature of between about 50° C. and about 150° C., e.g. about 130° C.

The gasifier may form part of a complex for hydrocarbon synthesis and which produces reaction water. In one or in a second humidification stage, the oxygen-containing stream may be contacted with said reaction water.

The reaction water being used to humidify the oxygen-containing stream may be heated before contacting the oxygen-containing stream therewith, and may have a feed temperature of between about 100° C. and about 280° C., e.g. about 190° C.

Typically, the reaction water includes oxygenated hydrocarbons such as alcohols, ketones, aldehydes and acids. At least some of these oxygenated hydrocarbons may be taken up by the oxygen-containing stream during humidification When the hot aqueous liquid is reaction water, the water is typically used for humidification on a once through basis, whereafter the reaction water may be routed to a water treatment plant or facility. Advantageously, at least some of these oxygenated hydrocarbons may thus be added in this fashion to the gasifier and less has to be treated or removed.

In one, or as an alternative embodiment of the second humidification stage, the oxygen-containing stream may be contacted with water used to cool reaction product from a hydrocarbon synthesis stage. This water may be reaction water. The reaction product may be gaseous product at least a portion of which is condensed in order to separate components thereof, e.g. reaction water and heavy hydrocarbons. Instead, the reaction product may be a liquid product, e.g. wax, which is cooled before further processing or use.

Typically, the gasifier will form part of a larger complex using or producing the synthesis gas. Such larger complex typically also includes a boiler stage. In one, or as a further alternative embodiment of the second humidification stage, the oxygen-containing stream may be contacted with boiler blow-down water.

The boiler blow-down water being used to humidify the oxygen-containing stream will be at the equilibrium temperature for water at the given steam generation pressure in the steam drum of the boiler from where the boiler blow down originates. For a steam generation pressure of around 44 bar (absolute), this temperature is about 257° C., and at 60 bar (absolute) steam generation pressure this temperature is about 275° C. The higher the pressure and thus equilibrium temperature, the less boiler blow down is required to obtain a certain water vapour fraction in the humidified oxygen-containing stream. Thus, the boiler blow-down water being used to humidify the oxygen-containing stream may have a feed temperature of between about 200° C. and about 350° C., e.g. about 260° C.

The flow rate of boiler blow-down water may be increased above what is strictly required for boiler operation. Boiler stage feed water may be preheated in indirect heat exchange with one or more hot process streams produced in the larger complex. In a preferred embodiment, boiler stage feed water is preheated against indirect cooling of synthesis gas produced in the gasifier. Advantageously, preheating of boiler stage feed water provides a sink for low grade heat and reduces the need for additional coal to support the increased rate of boiler blow-down water.

Boiler stage feed water may be preheated from about ambient temperature to just lower than boiling point, e.g. about 90° C. before being de-aerated. De-aerated boiler stage feed water may be further preheated from boiling point in the de-aerator to about 10° C. below the boiler steam generation temperature which is about 257° C. for 45 bar (absolute) steam and about 350° C. for 165 bar (absolute) steam.

The boiler blow-down water, typically with an increased dissolved oxygen concentration, may be returned from the humidification stage, i.e. after humidifying the oxygen-containing stream, as feed water to the boiler stage. It may then be necessary to flash the water at a reduced pressure in a flash stage following the humidification stage, in order to remove at least some of the dissolved oxygen. The flash stage preferably precedes the preheating of water fed to the boiler stage.

The flash stage may be operated at atmospheric pressure or may be replaced by a de-aerator.

The oxygen-containing stream may be contacted with the hot aqueous liquid in any suitable conventional gas liquid contacting device, e.g. a packed column or tower.

The method typically includes feeding steam to the gasifier as a gasification agent. The steam and humidified oxygen-containing streams may be combined before being fed to the gasifier.

The hydrocarbon synthesis may be Fischer-Tropsch synthesis. The Fischer-Tropsch synthesis may be three-phase low temperature Fischer-Tropsch synthesis. The low temperature Fischer-Tropsch synthesis may be effected at a temperature of less than about 280° C., typically at a temperature between about 160° C. and about 280° C., preferably between about 220° C. and about 260° C., e.g. about 240° C.

Figure 2:
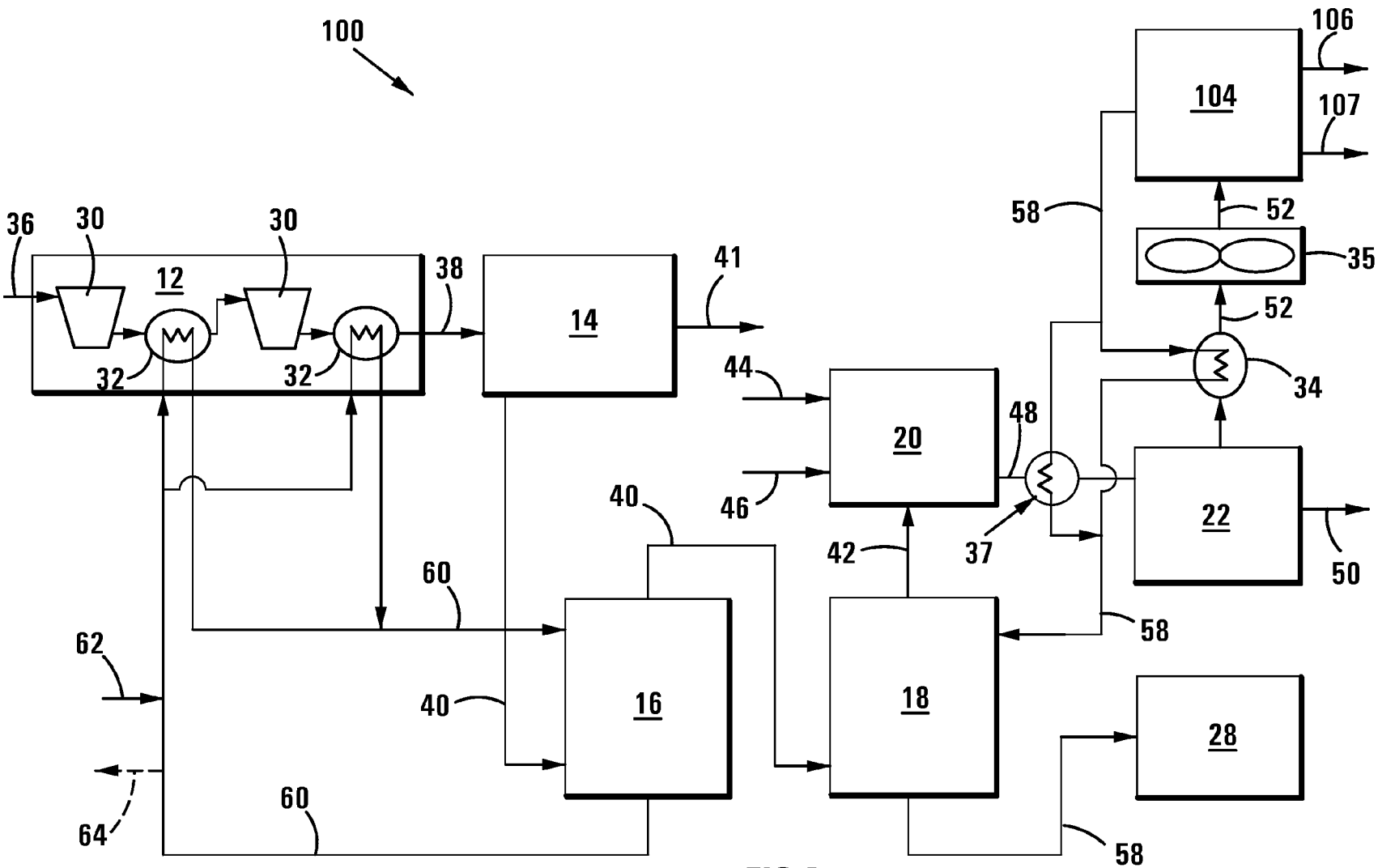
Figure 3:
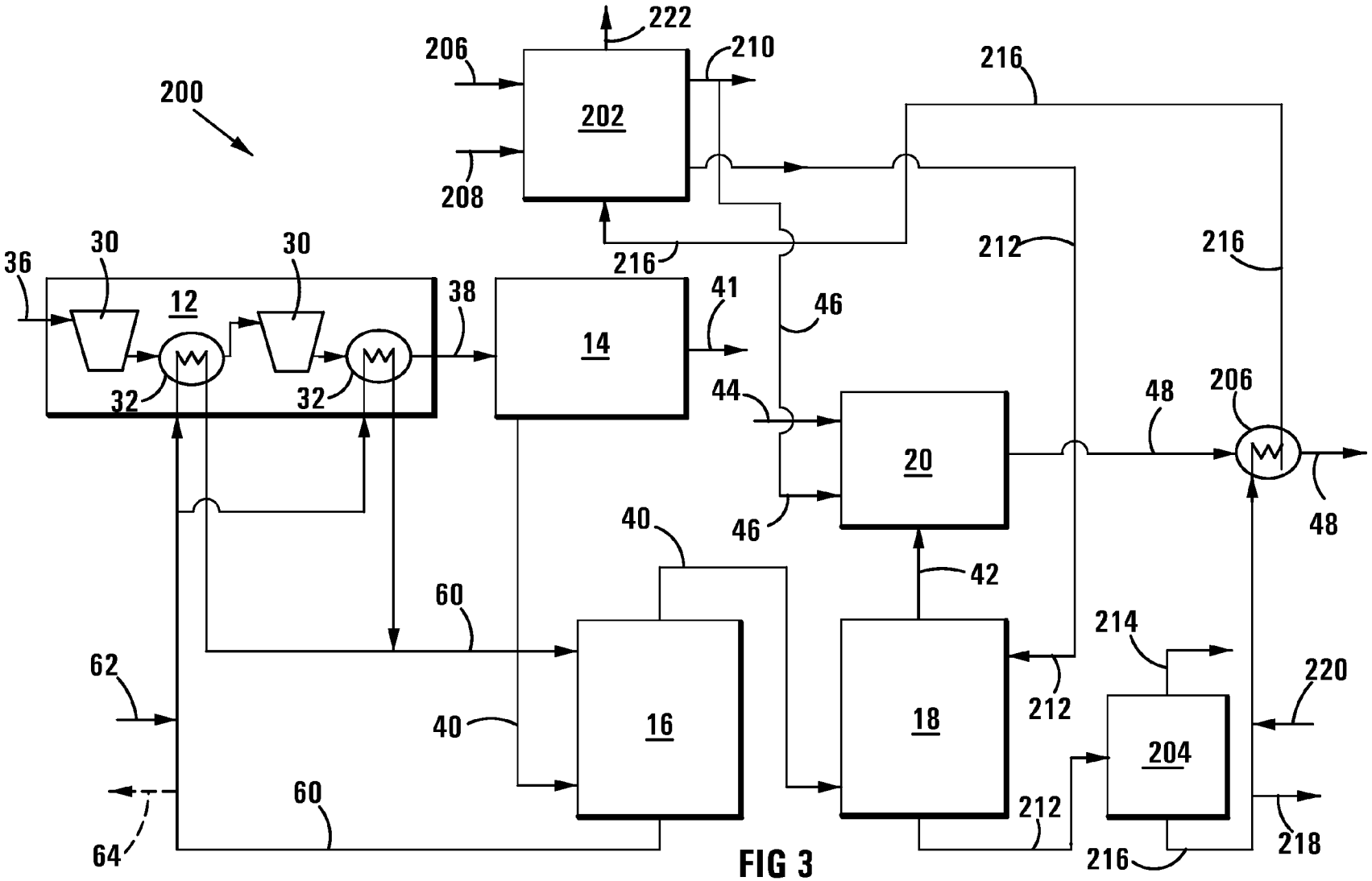

The invention will now be described, by way of example, with reference to the accompanying diagrammatic drawings in which FIG. 1 shows a hydrocarbon synthesis process which employs one embodiment of a method in accordance with the invention for the production of synthesis gas;

FIG. 2 shows another hydrocarbon synthesis process which employs another embodiment of a method in accordance with the invention for the production of synthesis gas; and FIG. 3 shows a process in accordance with the method of the invention for the production of synthesis gas.

Referring to FIG. 1 of the drawings, reference numeral 10 generally indicates a process for the production of hydrocarbons. The process 10 includes, broadly, an air compressor 12, an air separation unit (ASU) 14, a first humidification stage 16, a second humidification stage 18, a gasification stage 20, a Fischer-Tropsch hydrocarbon synthesis stage 22, a three-phase separator 24 and a water treatment stage 28.

The air compressor 12 includes a plurality of compression stages 30, two of which are shown in FIG. 1, as well as a plurality of intercoolers 32, two of which are shown in FIG. 1. The process 10 further includes a gaseous product cooler 34 and an air-cooled cooler 35 between the Fischer-Tropsch hydrocarbon synthesis stage 22 and the three-phase separator 24.

An air feed line 36 leads to the air compressor 12, with a compressed air line 38 leading from the air compressor 12 to the ASU 14. An oxygen line 40 leads from the ASU 14 to the first humidification stage 16 and then from the first humidification stage 16 to the second humidification stage 18. A humidified oxygen line 42 connects the second humidification stage 18 and the gasification stage 20. The gasification stage 20 is also being joined by a coal feed line 44 and a steam feed line 46, with a synthesis gas line 48 leading from the gasification stage 20 to the Fischer-Tropsch hydrocarbon synthesis stage 22.

A liquid hydrocarbon product line 50 and a gaseous product line 52 lead from the Fischer-Tropsch hydrocarbon synthesis stage 22. The gaseous product line 52 leads through the gaseous product cooler 34 and the cooler 35 to the three-phase separator 24, from where a liquid hydrocarbon line 54 and a tail gas line 56 lead. A reaction water line 58 also leads from the three-phase separator 24 to the second humidification stage 18, via the gaseous product cooler 34, before leading to the water treatment stage 28.

A cooling water circulation line 60 leads through the intercoolers 32 into the first humidification stage 16, before returning to the intercoolers 32. A cooling water make-up line 62 and an optional cooling water blow-down line 64 are also provided.

In use, air is sucked into the air compressor 12 through the air feed line 36 where the air is compressed, using the compression stages 30. In between the compression stages 30, the air is cooled by means of the intercoolers 32, using the cooling water in the cooling water circulation line 60. The cooling water is of boiler feed quality and is at a pressure of about 1 000 to 4 500 kPa (absolute). Compressed air leaves the air compressor 12 by means of the compressed air line 38 and is separated in the air separation unit 14 to produce a compressed substantially dry oxygen stream, fed by means of the oxygen line 40 to the first humidification stage 16, and one or more further gaseous streams as indicated by the line 41. Conventional cryogenic separation technology is used in the air separation unit 14 to separate the air. The oxygen stream in the oxygen line 40 is typically at a pressure of about 3 000 to 4 500 kPa (absolute) and ambient temperature which could be about 20 to 30° C.

The cooling water from the intercoolers 32 is fed by means of the cooling water circulation line 60 into the first humidification stage 16 where the cooling water is contacted with the oxygen stream using conventional gas liquid contacting technology e.g. a packed tower. When entering the first humidification stage 16, the cooling water is at a temperature of about 100 to 120° C. In the first humidification stage 16, the cooling water is cooled down by the cold oxygen stream from the ASU 14 with the cold oxygen stream being heated and humidified by the cooling water. The cooling water leaves the first humidification stage 16 at a temperature of about 40° C. The cooling water is thus cold enough to be returned to the intercoolers 32 for cooling duty. Cooling water make-up is provided through the cooling water make-up line 62 to account for water being taken up by the oxygen stream in the first humidification stage 16. If required, some of the cooling water may also be blown down using the cooling water blow-down line 64.

In the first humidification stage 16, the cold oxygen stream is humidified to a water concentration of about 3% by volume and heated to a temperature of about 100 to 120° C. The partially heated, partially humidified oxygen stream is then fed to the second humidification stage 18 (typically also a packed tower) by means of the oxygen line 40. In the second humidification stage 18, the oxygen stream is further heated and humidified by contacting the oxygen stream with reaction water fed into the second humidification stage 18 by means of the reaction water line 58. The reaction water fed into the second humidification stage 18 is at a temperature of about 180 to 220° C. and leaves the second humidification stage 18 at a temperature of about 120 to 150° C. In the second humidification stage 18, the oxygen stream is heated to a temperature of about 160° C. and further humidified to a water concentration of about 22% by volume. The heated, humidified oxygen is then fed by means of the humidified oxygen line 42 to the gasification stage 20.

The gasification stage 20 comprises a fixed bed dry bottom gasifier (typically a plurality thereof). In the gasification stage 20, solid carbonaceous material, i.e. coal, is gasified using the humidified oxygen stream and steam as moderating agent. The coal is fed into the gasification stage 20 by means of the coal feed line 44 and the steam is supplied via the steam feed line 46. The gasification stage 20 produces synthesis gas which is removed by means of the synthesis gas line 48, as well as ash. The removal of the ash from the gasification stage 20 is not shown in FIG. 1.

The synthesis gas removed from the gasification stage 20 by means of the synthesis gas line 48 is typically subjected to cooling and various cleaning stages, e.g. a sulphur removal stage (not shown), before being fed into the Fischer-Tropsch hydrocarbon synthesis stage 22 for Fischer-Tropsch hydrocarbon synthesis.

The Fischer-Tropsch hydrocarbon synthesis stage 22 is a conventional three-phase low temperature catalytic Fischer-Tropsch hydrocarbon synthesis stage, operating at a temperature of about 240° C. and a pressure of 2 000 to 2 500 kPa (absolute). Liquid hydrocarbon product is produced in the Fischer-Tropsch hydrocarbon synthesis stage 22 and removed by means of the liquid hydrocarbon product line 50 for further treatment. The Fischer-Tropsch hydrocarbon synthesis stage 22 also produces gaseous products which are removed by means of the gaseous product line 52 and passed through the gaseous product coolers 34 and 35 where the gaseous products are cooled down to a temperature of about 40 to 70° C. to form a three-phase mixture, which comprises condensed hydrocarbons, reaction water, and tail gas. This mixture is fed into the three-phase separator 24. In the three-phase separator 24, the mixture is separated producing a liquid hydrocarbon product which is removed by means of the liquid hydrocarbon line 54 and a tail gas which is removed by means of the tail gas line 56. The three-phase separator 24 also produces a reaction water stream which is removed by means of the reaction water line 58.

The tail gas removed along the tail gas line 56 may, amongst other options, be subjected to further purification stages, used as a fuel gas or recycled to the Fischer-Tropsch hydrocarbon synthesis stage 22. These options are not illustrated in FIG. 1 of the drawings.

The reaction water stream comprises predominantly water and dissolved oxygenated hydrocarbons. The reaction water stream is fed to the gaseous product cooler 34 to cool the gaseous product from the Fischer-Tropsch hydrocarbon synthesis stage 22 in indirect heat exchange relationship. The reaction water stream being fed to the gaseous product cooler 34 is typically at a temperature of about 40 to 70° C. and leaves the gaseous product cooler 34 at a temperature of about 180 to 220° C. The hot reaction water stream is then fed into the second humidification stage 18, as hereinbefore described, further to heat and humidify the oxygen stream.

Cooled reaction water from the second humidification stage 18 is removed by means of the reaction water line 58 and fed to the water treatment stage 28, where the reaction water is treated to recover dissolved oxygenated hydrocarbons, before the water is discarded.

If desired or necessary, reaction water from the three-phase separator 24 may be subjected to treatment in the water treatment stage 28 before the reaction water is used in the gaseous product cooler 34 and in the second humidification stage 18. This option is illustrated by the optional reaction water flow lines 66.

As will be appreciated, the hot reaction water being fed into the second humidification stage 18 may thus include more or less dissolved oxygenated hydrocarbons. Some of these hydrocarbons may be stripped, in the second humidification stage 18, from the reaction water by the oxygen stream, to be fed with the humidified oxygen into the gasification stage 20.

Referring now to FIG. 2 of the drawings, reference numeral 100 generally indicates a further process in accordance with the invention for producing hydrocarbons. The process 100 is similar to the process 10 and unless otherwise indicated, the same or similar parts or features are indicated by the same reference numerals.

The process 100 includes a liquid knockout stage 104, following the Fischer-Tropsch hydrocarbon synthesis stage 22. The process 100 further includes a heat exchanger 37 between the gasification stage 20 and the hydrocarbon synthesis stage 22. In use, the gaseous product from the Fischer-Tropsch hydrocarbon synthesis stage 22 is only partially cooled in the cooler 34 and the air cooler 35 to a temperature of about 100° C. At this temperature and at the outlet pressure of the Fischer-Tropsch hydrocarbon synthesis stage 22, a three-phase mixture comprising an uncondensed phase, a hot hydrocarbon phase and a hot reaction water phase results. This three-phase mixture is fed into the liquid knockout stage 104 to produce a reaction water stream, the hydrocarbon stream and a gaseous product stream. The gaseous product stream and the hydrocarbon stream are removed by means of a gaseous product line 106 and a liquid product line 107 respectively and are subjected to further work-up and separation stages, which are not shown.

The hot reaction water stream has less dissolved oxygenated hydrocarbons than what it would have had if it was knocked out at 40° C. This hot reaction water stream can thus safely be used for the saturation of oxygen without the risk of combustion with the oxygen and without partial or full treatment of the water before use, as may be required in the process 10. The hot reaction water stream from the water knockout stage 104 is split and fed via the heat exchangers 34 and 36 by means of the reaction water line 58 into the second humidification stage 18 further to heat and humidify the oxygen stream, as hereinbefore described with reference to the process 10. In the second humidification stage 18, the oxygen stream is heated to a temperature of about 160° C. and humidified to have a water concentration of about 22% by volume. The humidified oxygen stream from the second humidification stage 18 will typically also include hydrocarbons stripped from the reaction water after cooling (not shown).

In the second humidification stage 18, the reaction water is cooled to a temperature of about 140° C. The cooled reaction water is removed by means of the reaction water line 58 and transferred to the water treatment stage 28.

Referring now to FIG. 3 of the drawings, reference numeral 200 generally indicates a process in accordance with the method of the invention for the production of synthesis gas. The process 200 is similar to parts of the processes 10 and 100 and unless otherwise indicated, the same or similar parts or features are indicated by the same reference numerals.

The process 200 does not show any specific downstream use of the produced synthesis gas withdrawn along the synthesis gas line 48. The process 200 includes a boiler stage 202, a boiler blow-down flash drum 204, and a synthesis gas cooler 206.

A coal feed line 208 and an air feed line 206 lead into the boiler stage 202. A flue gas line 222 leads from boiler stage 202. A high pressure steam line 210 connects boiler stage 202 to downstream users (generally not shown), and in particular the steam feed line 46 to the gasification stage 20 branches off the high pressure steam line 210. A boiler blow-down water line 212 connects the boiler stage 202 to the second humidification stage 18 and from there leads on to the flash drum 204. A low pressure steam line 214 leads from the flash drum 204 to other users (not shown). A boiler stage feed water line 216 leads from the flash drum 204 to the boiler stage 202 via the synthesis gas cooler 206, itself located on the synthesis gas line 48. Provision is made for blow-down and make-up to the boiler stage feed water line 216 along lines 218 and 220 respectively.

In use coal and combustion air are fed to the boiler stage 202 along the respective feed lines 206, 208 and combusted, with the resulting flue gas withdrawn along the flue gas line 222. The heat released by this combustion is used to bring water fed along the boiler stage feed water line 216 to boiling point, and converting a portion to superheated steam that is withdrawn along the high pressure steam line 210. A portion of the water at its boiling point is withdrawn along the boiler blow-down water line 212 and fed to the second humidification stage 18, where it is used to further heat and humidify the oxygen stream, as hereinbefore described with reference to the processes 10, 100. In the second humidification stage 18, a portion of the boiler blow-down water vaporises and the oxygen stream is heated to a temperature of about 210° C. and humidified to have a water concentration of about 63% by volume.

In the second humidification stage 18, the boiler blow-down water is cooled to a temperature of about 150° C. The cooled boiler blow-down water is removed by means of the boiler blow-down water line 212 and transferred to the flash drum 204.

In the flash drum 204, operated at atmospheric pressure, enough of the oxygen dissolved in the boiler blow-down water in the second humidification stage 18 is removed along with low pressure steam formed in the flash, to use a liquid bottom product removed by line 216, after conventional chemical treatment, as boiler feed water. The low pressure steam and oxygen are removed along the low pressure steam line 214. The liquid product from the flash drum 204 is the boiler stage feed water and is thus withdrawn along boiler stage feed water line 216. The boiler stage feed water is then preheated to a temperature of 180° C. in indirect heat exchange with the synthesis gas in the synthesis gas cooler 206, before it is fed to the boiler stage 202.

In whatever embodiment the invention may be practised, safety considerations dictate that the hot aqueous liquid used to humidify the oxygen-containing stream by contacting therewith, should not contain flammable components in such concentrations that it may result in these flammable components being present in the humidified oxygen-containing stream in concentrations between the lower and higher explosive limits of the humidified oxygen-containing stream. In addition, dissolved solids and oxygen in the hot aqueous liquid should not cause excessive corrosion of the chosen materials of construction.

The Applicant believes that the invention, as illustrated, results in improved efficiency in the manufacturing of synthesis gas, particularly when a low temperature non-slagging gasifier, such as a low temperature fixed bed dry bottom gasifier is used to gasify coal. Less high pressure steam is required as feed to the gasifier, as a portion of the gasification agent steam requirement is supplied together with the humidified oxygen. This will typically result in a reduction in coal usage. Depending on the temperature of the high pressure steam gasification agent of which a portion is now supplied together with the humidified oxygen, it is possible that the temperature of the combined gasification agents fed to the gasifier is higher than when the oxygen is not humidified. This may lead to slight reductions in the oxygen required to support the endothermic gasification reactions. Furthermore, the method of the invention, as illustrated, also provides a value-added sink for low temperature heat sources typically found in air separation units or in complexes using or producing synthesis gas. In the method of the invention, as illustrated, the load on an evaporative plant cooling water system is reduced as plant cooling water is not used to cool the compressed air or the synthesis unit product gas. In the method of the invention, as illustrated in FIG. 3, the load on an evaporative plant cooling water system is even further reduced as plant cooling water is also not used to cool the synthesis gas produced in the gasification stage. This will lead to a water saving. When using reaction water to humidify the oxygen stream, as illustrated in FIGS. 1 and 2, the amount of reaction water that has to be treated is also advantageously reduced. The method of the invention, when used in a process to produce hydrocarbons, as illustrated, thus has the potential to increase overall carbon efficiency and to reduce plant $CO_2$ emissions. This is important, as the $CO_2$ emissions which are least capture ready on a large coal to liquids plant are from the coal powered steam plant. Reducing these emissions are thus of particular value in meeting reduced $CO_2$ emission specifications.

The invention makes it possible to increase the amount of steam obtained from current coal-based hydrocarbon synthesis plants (e.g. coal to liquids or CTL plants) without the addition of boilers to generate steam from low level heat. For new plants, the capacity of coal-fired boilers can be decreased, resulting in less $CO_2$ production and thus a more competitive gasification footprint. The advantages will be lower capital cost and a reduced environmental footprint for coal-based hydrocarbon synthesis plants, especially so when fixed bed dry bottom (e.g. Sasol-Lurgi gasification) is employed.

The invention claimed is:

1. A method for the production of synthesis gas, the method including producing an oxygen-containing stream in an air separation unit;

humidifying the oxygen-containing stream by contacting the oxygen-containing stream with a hot aqueous liquid to produce a humidified oxygen-containing stream;

said humidifying of the oxygen-containing stream including heating the oxygen-containing stream by directly contacting the oxygen-containing stream with the hot aqueous liquid; and feeding the humidified heated oxygen-containing stream into a low temperature non-slagging gasifier in which a carbonaceous material is being gasified, thereby to produce synthesis gas, the gasifier forming part of a complex for Fischer-Tropsch hydrocarbon synthesis and which produces reaction water, with the oxygen-containing stream being contacted with said reaction water, and in which the reaction water includes oxygenated hydrocarbons, with at least some of these oxygenated hydrocarbons being taken up by the oxygen-containing stream during humidification.

2. The method as claimed in claim 1, in which the humidified oxygen-containing stream being fed into the gasifier is at a temperature of at least 160° C.

3. The method as claimed in claim 1, in which the humidified oxygen-containing stream being fed into the gasifier has a water concentration of at least 3% by volume.

4. The method as claimed in claim 3, in which the humidified oxygen-containing stream being fed into the gasifier has a water concentration of between 40% and 90% by volume.

5. The method as claimed in claim 1, in which the oxygen-containing stream is humidified in more than one humidification stage.

6. The method as claimed in claim 1, in which the oxygen-containing stream is contacted with water used as cooling water.

7. The method as claimed in claim 1, in which the oxygen-containing stream is contacted with hot water having a conductivity less than 120 microSiemens which is used in a substantially closed circuit.

8. The method as claimed in claim 1, in which the oxygen-containing stream is contacted with water used as cooling water to cool a compressed gaseous stream in the air separation unit producing the oxygen-containing stream.

9. The method as claimed in claim 1, in which the oxygen-containing stream is contacted with water used to cool reaction product from a hydrocarbon synthesis stage.

10. The method as claimed in claim 9, in which the water is reaction water.

11. The method as claimed in claim 1, which includes operating a boiler stage and in which the oxygen-containing stream is contacted with boiler blow-down water.

12. The method as claimed in claim 11, in which the flow rate of boiler blow-down water is increased above what is strictly required for boiler operation, and in which boiler stage feed water is preheated in indirect heat exchange with one or more hot process streams.

13. The method as claimed in claim 11, in which the boiler blow-down water, with an increased dissolved oxygen concentration, is returned after humidifying the oxygen-containing stream as feed water to the boiler stage.

14. The method as claimed in claim 1, which includes feeding steam to the gasifier as a gasification agent, the steam and the humidified oxygen-containing streams being combined before being fed to the gasifier.

15. The method as claimed in claim 1, in which the gasifier is a fixed bed dry bottom gasifier, with the humidified oxygen-containing stream, steam and solid carbonaceous material being fed into said gasifier so that the carbonaceous material is gasified in the presence of oxygen and steam to produce synthesis gas and ash, the method including removing the synthesis gas and ash from the gasifier.

* * * * *

UNITED STATES PATENT AND TRADEMARK OFFICE

CERTIFICATE OF CORRECTION

PATENT NO. : 8,158,029 B2
APPLICATION NO. : 12/375633
DATED : April 17, 2012
INVENTOR(S) : Werner Siegfried Ernst It is certified that error appears in the above-identified patent and that said Letters Patent is hereby corrected as shown below:

Column 1,
Line 28, "...technology)." should be -- ...technology.) --.

Column 9,
Line 13, "are" should be -- is --.

Signed and Sealed this
Tenth Day of July, 2012

David J. Kappos

David J. Kappos
*Director of the United States Patent and Trademark Office*